United States Patent [19]

Ohkubo

[11] Patent Number: 4,974,324

[45] Date of Patent: Dec. 4, 1990

[54] APPLIANCE FOR CUTTING OUT THIN FILM

[75] Inventor: Katsuo Ohkubo, Saitama, Japan

[73] Assignee: Somar Corporation, Tokyo, Japan

[21] Appl. No.: 386,188

[22] Filed: Jul. 28, 1989

[30] Foreign Application Priority Data

Jul. 30, 1988 [JP] Japan ..... 63-101517[U]
Jul. 30, 1988 [JP] Japan ..... 63-101518[U]

[51] Int. Cl.[5] ..... B42F 1/00; B26B 3/00

[52] U.S. Cl. ..... 30/366; 30/164.9

[58] Field of Search ..... 30/366, 164.9, 164.6, 30/164.7; 81/9.2, 9.21; 51/216 LP, 216 A, 217 L; 33/28, 200, 507

[56] References Cited

U.S. PATENT DOCUMENTS 2,524,636 10/1950 Preis et al. ..... 30/164.9
2,730,811 1/1956 Gouldsmith, Jr. ..... 30/366
2,748,474 6/1956 Brown ..... 30/164.9
2,810,960 10/1957 Johnson et al. ..... 30/164.9
2,902,760 8/1959 Koenig ..... 30/164.9
3,107,425 10/1963 Rentz ..... 30/164.9
3,339,279 9/1967 Sovar et al. ..... 30/164.9
4,713,886 12/1987 Ikeda ..... 30/366

*Primary Examiner*—Douglas D. Watts
*Assistant Examiner*—Paul M. Heyrana, Sr.
*Attorney, Agent, or Firm*—Sughrue, Mion, Zinn, Macpeak & Seas

[57] ABSTRACT

A cutting appliance for cutting a thin film has a cutter with a cutting edge held in a frame which slides on the thin film. The cutter is positioned to extend down to the plane of the bottom of the frame, where said frame has an opening therein. A magnifying glass is positioned obliquely with respect to the thin film and has a focal point substantially at the cutting edge of the cutter to enable good viewing by the operator of the appliance.

7 Claims, 3 Drawing Sheets

APPLIANCE FOR CUTTING OUT THIN FILM

BACKGROUND OF THE INVENTION

The present invention relates to a thin film cutting appliance used for making cut-out masks for photoengraving.

According to a conventional method of cutting thin film, a colored translucent plastic thin film is overlaid on a photograph, which constitutes an original. The portion of the film, which has the same size as the outline of the photograph, is cut along the outline by a cutter so as to be used for subsequent design applications. According to another conventional method, a film coated with a light-blocking thin film is overlaid on a photograph, which constitutes an original, and the portion of the thin film, which has the same size as the outline of the photograph, is cut along the outline by a cutter. Each of the cutters is shaped like a stencil pen and held by the operator. It requires a substantial amount of skill to maintain each of the cutters at the prescribed angles, and since the inclination of the cutting edge of the cutter always changes, it makes it difficult to accurately cut the thin film.

For these reasons, an appliance has recently been developed and is disclosed in Japanese Utility Model Application (OPI) No. 197145/87 (the term "OPI" as used herein means an "unexamined published application"). The appliance has a frame shaped as a short cylinder or pipe and a level bottom end which is placed on a film coated with a light-blocking thin film. The level end is the bottom of the frame and the frame is then moved so that a portion of the thin film, which has a desired size, is cut out along the outline of a photograph by a cutter mounted inside the frame.

In the above-mentioned appliance, which is shown in FIG. 1, the cutter 4' is hung on a support arm 3' so as to extend down in the cylindrical frame 1' and is always urged downward by a plate spring 5' attached to the support arm. However, since the cylindrical frame 1' limits the field of vision, it is often difficult to properly align the cutting edge of the cutter 4' with respect to the photograph. Also, since the downward pressure applied to the cutter 4' by the plate spring 5' is constant, the cutting force of the cutter cannot be finely controlled like a stencil pen to efficiently cut the thin film.

SUMMARY OF THE INVENTION

The present invention has as an object the solution of the above-mentioned problems. According to the invention, it is possible to always view the cutting edge of a cutter and a portion of a photograph in relation to each other without being affected by the presence of a frame surrounding the cutter. Also, the downward pressure applied to the cutter is easily controllable.

DESCRIPTION OF THE PREFERRED EMBODIMENTS

Figure 1:
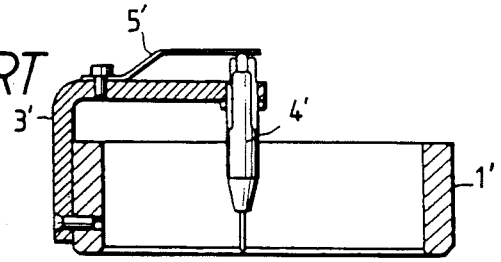
FIG. 1 PRIOR ART
FIG. 1 is a longitudinal sectional view of a conventional appliance for cutting a thin film.
Figure 2:
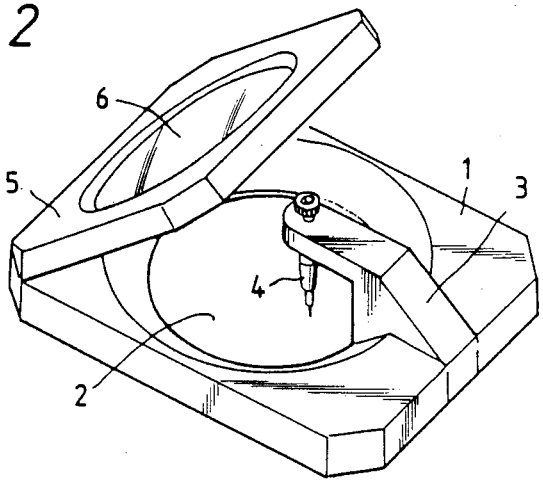
FIG. 2 is a perspective view of a thin film cutting appliance, which is an embodiment of the present invention.
Figure 3:
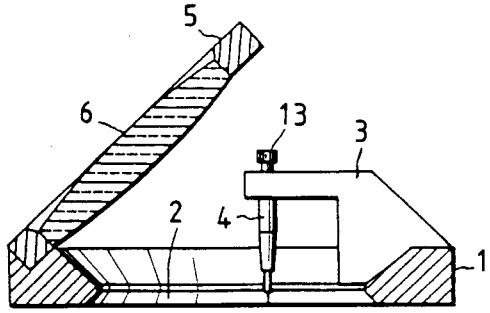
FIG. 3 is a longitudinal sectional view of the device shown in FIG. 2.

One embodiment of the present invention, which is an appliance for cutting a thin film, is hereafter described with reference to FIGS. 2, 3, 4 and 5. The appliance comprises a frame 1, a support arm 3, a cutter 4, an oblique plate 5 and a magnifying lens 6. The frame 1 and the oblique plate 5 are made of a transparent plastic. The frame 1 is a thick square board and has a circular through opening 2 in the central portion of the frame. The support arm 3 is set up on a central part of one of the mutually opposite portions of the frame 1. The cutter 4 is hung from the tip of the support arm 3. The oblique plate 5 is attached to the other of the mutually opposite portions of the frame 1 at an angle of about 45 thereto. The magnifying lens 6 is fitted in the central portion of the oblique plate 5.

Figure 4:
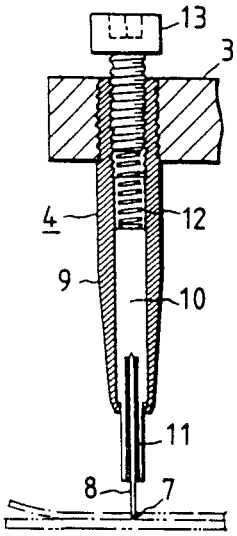
FIG. 4 is a longitudinal sectional view of the cutter of the appliance shown in FIG. 2.
Figure 5:
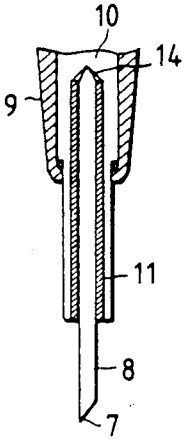
FIG. 5 is an enlarged sectional view of a part of the cutter.

As shown in FIGS. 4 and 5, the cutter 4 comprises a cutting member 8 made of a thin wire and provided with a cutting edge 7 at the lower end of the cutting member by obliquely cutting off the wire at one end thereof, a holder 11 coupled to the lower end of a vertically movable rod 10 fitted in a vertical cylinder 9 attached to the support arm 3, a viscous fluid 15 such as grease and petrolatum provided between the cutting member and the holder, a spring 12 provided in the vertical cylinder, and a push screw 13. The cutting member 8 is inserted in the holder 11 so that the cutting member is supported. The height of the cutting edge 7 can be adjusted, by turning the push screw 13, through the action of the spring 12 interposed between the screw and the vertically movable rod 10. The upper end of the cutting member 8 is a needle-like sharp-pointed end 14 movably engaged in the conical recess of the holder 11 so that the cutting member is always lightly rotatably supported non-eccentrically.

Figure 6:
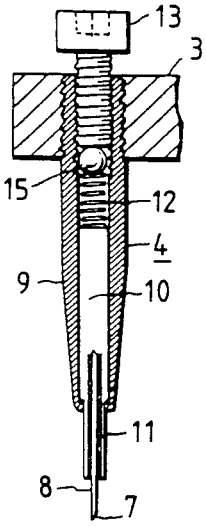
FIG. 6 is a longitudinal sectional view of a part of a thin film cutting appliance which is a modification of the embodiment of FIG. 2.

FIG. 6 is a longitudinal sectional view of a thin film cutting appliance which is a modification of the above-described embodiment. In the appliance shown in FIG. 6, a small ball 15 is interposed between spring 12 and the push screw 13, so that the screw can be turned more lightly than the appliance shown in FIGS. 2, 3, 4 and 5. Otherwise, the appliance shown in FIG. 6 is the same as that shown in FIGS. 2, 3, 4 and 5.

The focal point of the magnifying lens 6 is nearly coincident with the cutting edge 7 of the cutting member 8. Since the diameter of the lens 6 is nearly equal to that of the through opening 2 of the frame 1, the edge of the frame around the opening can hardly be seen through the lens.

Although the lens 6 is secured to the central portion of the oblique plate 5 by fitting, the present invention is not confined thereto but may be otherwise embodied so that the lens is secured to the central portion of the oblique plate by other means such as adhesive bonding.

Another embodiment of the invention is described with reference to FIGS. 7, 8 and 9. The appliance comprises a frame 101, a magnifying lens 103, a cutter 104, and a support member 105. The frame 101 and the support member 105 are made of a transparent plastic. The frame 101 is made of a pipe having a partially rectangular cross-section and obliquely cut off at an angle of about 45° to the axis of the pipe so that the frame has an opening 102 at the obliquely cut-off end of the frame. The other end of the frame 101 is made circular. The magnifying lens 103 is fitted in the circular end of the frame 101. The cutter 104 is attached with the support member 105 to the frame 101 so that the cutter extends through the peripheral portion of the frame. The lower end of the cutter is located nearly at the center of the opening 102, and the upper end of the cutter is located outside the frame. As shown in FIG. 9, the cutter 104 comprises a cutting member 108 made of a thin wire and provided with a cutting edge 107 at the lower end of the cutting member by obliquely cutting off the wire at one end thereof, a holder 111 coupled to the lower end of a vertically movable rod 110 provided in a vertical cylinder 109 attached to the support member 105, a viscous fluid such as grease and petrolatum provided between the cutting member and the holder, a spring 112 provided in the vertical cylinder, and a push screw 113. The cutting member 108 is inserted in the holder 111 so that the member is supported. The height of the cutting edge 107 can be adjusted by turning the push screw 113, through the action of the spring 112 interposed between the screw and the vertically movable rod 110. The construction and operation of the cutting member 108 are the same as those of the cutting member of the appliance shown in FIGS. 2, 3, 4 and 5.

Figure 7:
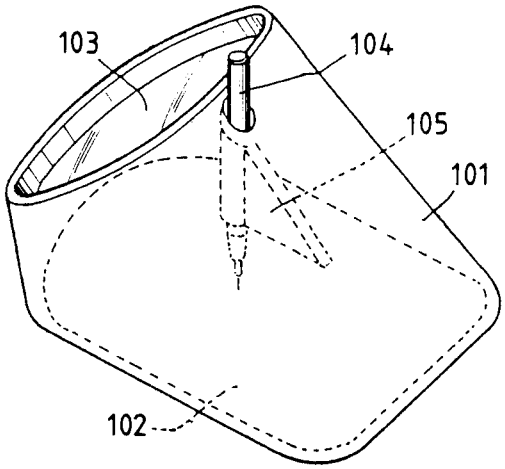
FIG. 7 is a perspective view of a thin film cutting appliance in accordance with another embodiment of the present invention.
Figure 8:
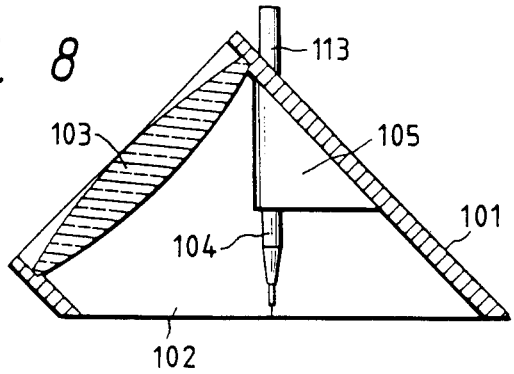
FIG. 8 is a longitudinal sectional view of the appliance shown in FIG. 7.
Figure 9:
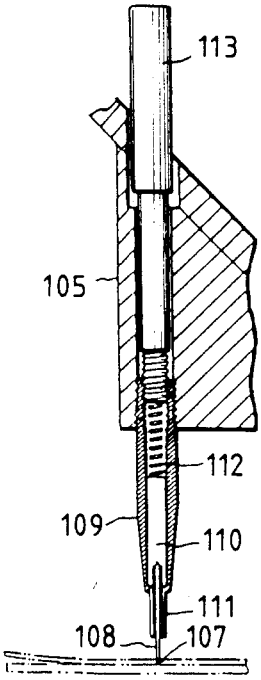
FIG. 9 is a longitudinal sectional view of the cutter of the appliance shown in FIG. 7.
Figure 10:
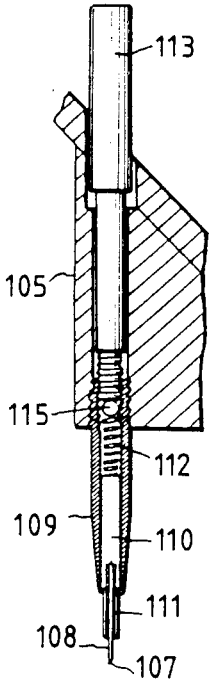
FIG. 10 is a longitudinal sectional view of the cutter of a thin film cutting appliance which is a modification of the embodiment shown in FIG. 7.

FIG. 10 is a longitudinal sectional view of a thin film cutting appliance which is a modification of the device shown in FIGS. 7, 8 and 9. In the appliance shown in FIG. 10, a small ball 115 is interposed between a spring 112 and a push screw 113 so that the screw can be turned more lightly than in the appliance shown in FIGS. 7, 8 and 9. Otherwise, the appliance shown in FIG. 10 is the same as that shown in FIGS. 7, 8 and 9.

As shown in FIG. 8, the magnifying lens 103 is attached to the frame 101 at an angle of about 45 thereto so that the focal point of the lens is nearly coincident with the cutting edge 107 of the cutter 108. Since the diameter of the lens 103 is nearly equal to the distance between the side edges of the opening 102 of the frame 101, the edge of the frame around the opening can hardly be seen through the lens.

Although the lens 103 is secured to the frame 101 by fitting, the present invention is not confined thereto but may be otherwise embodied so that the lens is secured to the frame by other means such as adhesive bonding.

Each of the above-described appliances is placed on a film coated with a light-blocking thin film and overlaid on a photograph, so that the magnifying lens faces the operator who manipulates the appliance. The push screw of the cutter is turned to adjust the downward pressure applied to the cutting member thereof. The cutting edge of the cutter is then caused to cut into the films. The whole appliance is held by the fingers of the operator so that the appliance is moved over the films. Since the cutting edge is eccentrically located with regard to the axis of the cutting member, the member is automatically turned along with the movement of the appliance so that the cutting edge is always oriented in the direction of the movement. Since the magnified image of the cutting edge of the cutter and the surface of the thin film can be seen through the magnifying lens, and since the frame is hardly visible through the lens, the films can be efficiently and easily cut. The downward pressure applied to the cutting member can be adjusted by the push screw as occasion demands. Besides, the operator can easily hold the appliance without being likely to suffer injury due to the cutting edge.

What is claimed is:

1. A cutting appliance for permitting continuous cut to be applied to a thin film, comprising:

a manually moveable frame; the bottom of said frame having an opening therein defining an interior bottom edge, said frame being constructed to ride on and slide over a thin film to be cut;

a cutter having a cutting edge at one end thereof and a screw means at another end thereof for varying the pressure on said cutting edge;

a support attached to said frame and said cutter for positioning said cutter vertically in said frame such that said cutting edge extends substantially to the plane of the bottom of said frame; and a magnifying glass attached to said frame at an oblique angle with respect to said cutter and having a focal point substantially at said cutting edge.

2. A cutting appliance as claimed in claim 1, wherein:

said frame is a flat thick structure with said opening therein extending therethrough;

said support is an arm extending from said frame at one side of said frame to a central portion of said opening;

said arm holding said cutter vertically within said opening;

a magnifying glass holder extending obliquely from a side of said frame opposite said one side and holding said magnifying glass.

3. A cutting appliance for permitting continuous cut to be applied to a thin film, comprising;

a frame, the bottom of said frame having an opening therein defining an interior bottom edge, said frame being constructed to ride on and slide over a thin film to be cut;

a cutter having a cutting edge at one end thereof and a screw means at another end thereof for varying the pressure on said cutting edge;

a support attached to said frame and said cutter for positioning said cutter vertically in said frame such that said cutting edge extends substantially to the plane of the bottom of said frame; and a magnifying glass attached to said frame at an oblique angle with respect to said cutter and having a focal point substantially at said cutting edge wherein:

said frame has a shape of a section of a tube, the bottom thereof corresponding to an oblique cut across said tube and the top thereof corresponding to a right angle cut across said tube, resulting in a frame which stands at an oblique angle when the bottom is placed on said film;

said magnifying glass is positioned in the top opening of said frame;

and said support is an arm extending from an inner surface of said frame to support said cutter which extends vertically through an obliquely extending side of said frame.

4. A cutting appliance as claimed in any one of claims 1–3, wherein said magnifying glass is at a 45° angle with respect to the plane of the bottom of said frame.

5. A cutting appliance as claimed in any one of claims 1–3, wherein said magnifying glass is of a size which does not allow the operator to view the bottom interior edges of the frame through the magnifying glass.

6. A cutting appliance as claimed in any one of claims 1–3, wherein said cutter further comprises:

a cutting member, the end of which is said cutting edge;

a holder surrounding and holding said cutting member in a manner allowing vertical movement of said cutting member within said holder;

a grease or the like lubricating the inner side of said holder and the outer side of said cutting member;

a hollow cylinder attached to said support and communicating with said holder;

a rod within said cylinder and attached to said cutting member;

a spring positioned between the top of said rod and the bottom of said screw means.

7. A cutting appliance as claimed in claim 5, wherein said cutter further comprises a ball positioned in contact with the bottom of said screw means and the top of said spring.

* * * * *